US011001060B2

(12) United States Patent
Tanaka

(10) Patent No.: US 11,001,060 B2
(45) Date of Patent: May 11, 2021

(54) PIEZOELECTRIC ACTUATOR AND A MANUFACTURE METHOD OF THE PIEZOELECTRIC ACTUATOR

(71) Applicant: BROTHER KOGYO KABUSHIKI KAISHA, Nagoya (JP)

(72) Inventor: Taiki Tanaka, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/587,160

(22) Filed: Sep. 30, 2019

(65) Prior Publication Data

US 2020/0171826 A1 Jun. 4, 2020

(30) Foreign Application Priority Data

Nov. 30, 2018 (JP) ..... JP2018-225045

(51) Int. Cl.
*B41J 2/14* (2006.01)

(52) U.S. Cl.
CPC .. *B41J 2/14233* (2013.01); *B41J 2002/14241* (2013.01); *B41J 2002/14258* (2013.01); *B41J 2202/11* (2013.01)

(58) Field of Classification Search
CPC ..... B41J 2/14233; B41J 2002/14258; B41J 2202/11; B41J 2002/14241
See application file for complete search history.

(56) References Cited

U.S. PATENT DOCUMENTS 6,975,183 B2 * 12/2005 Aigner ..... H03H 9/0095 29/25.35

FOREIGN PATENT DOCUMENTS

JP 2010-241081 A 10/2010
JP 2013-256137 A 12/2013

* cited by examiner

*Primary Examiner* — Geoffrey S Mruk

(74) *Attorney, Agent, or Firm* — Scully, Scott, Murphy & Presser, P.C.

(57) ABSTRACT

A piezoelectric actuator comprises a vibration plate, a first electrode, a first piezoelectric layer, a second electrode, a second piezoelectric layer and a third electrode. With respect to a top-bottom direction orthogonal to a surface of the vibration plate, the vibration plate, the first electrode, the first piezoelectric layer, the second electrode, the second piezoelectric layer and the third electrode are stacked in this order. The second piezoelectric layer is narrower than the first piezoelectric layer in a first direction parallel to the surface of the vibration plate. The third electrode extends in the first direction and covers both side surfaces of both of the first piezoelectric layer and the second piezoelectric layer in the first direction.

8 Claims, 13 Drawing Sheets

PIEZOELECTRIC ACTUATOR AND A MANUFACTURE METHOD OF THE PIEZOELECTRIC ACTUATOR

CROSS-REFERENCE TO RELATED APPLICATION

This application claims priority from Japanese Patent Application No. 2018-225045 filed on Nov. 30, 2018, the content of which is incorporated herein by reference in its entirety.

TECHNICAL FIELD

Aspects described herein relate to a piezoelectric actuator and a manufacture method of the piezoelectric actuator.

BACKGROUND

A known piezoelectric actuator includes a piezoelectric element configured to apply pressure to ink in a pressure generating chamber. The piezoelectric element includes an elastic film, an insulating film, a plurality of first piezoelectric layers, a second piezoelectric layer, a first common electrode, a plurality of individual electrodes and a second common electrode. The elastic film covers pressure chambers aligned in one direction. The insulating film is disposed on an upper surface of the elastic film, covering the pressure chambers together with the elastic film. Each of the first piezoelectric members is disposed on an upper surface of the insulating film and overlaps a corresponding one of the pressure chambers in the top-bottom direction. The second piezoelectric layer extends continuously over the first piezoelectric layers, covering the upper surface of the insulating film having the first common electrode thereon, upper surfaces of the first piezoelectric layers, and one side surfaces of the first piezoelectric layers in the one direction. The first common electrode is disposed between the insulating layer and the first piezoelectric layers, extending continuously over the first piezoelectric layers. Each of the individual electrodes is disposed between a corresponding one of the first piezoelectric layers and the second piezoelectric layer. The second common electrode is disposed on an upper surface of the second piezoelectric layer, extending continuously over the first piezoelectric layers.

In a known piezoelectric element, a portion of the first piezoelectric layer, which is sandwiched between the first common electrode and an individual electrode, functions as an active portion to be deformable by a potential difference therebetween, and a portion of the second piezoelectric layer, which is sandwiched between the second common electrode and an individual electrode, functions as an active portion to be deformable by a potential difference therebetween. In known piezoelectric elements, deformation of the two active portions generates great deformation of portions of the elastic film, the insulating film, the first piezoelectric layer and the second piezoelectric layer, which overlap the pressure chamber in the top-bottom direction, thus applying a great pressure to the ink in the pressure chamber.

SUMMARY

As described above, the piezoelectric element is structured that the second piezoelectric layer covers the one side surface of the first piezoelectric layer in the one direction, which may lead to the need to increase the physical size of the piezoelectric element in the one direction. The second piezoelectric layer has a portion covering the one side surface of the first piezoelectric layer, which is a non-active portion that will not be deformed by a potential difference between the individual electrode, the first piezoelectric layer and the second piezoelectric layer. When the active portions are deformed, the non-active portion impedes the deformation of portions of the elastic film, the insulating film, the first piezoelectric layer, and the second piezoelectric layer, which overlap the pressure chamber. The non-active portion lowers the efficiency to deform the piezoelectric element.

One or more aspects of the disclosure provide a piezoelectric actuator having a reduced size and a higher deformation efficiency than known piezoelectric actuators and a method of manufacturing the piezoelectric actuator. According to an aspect of the disclosure, a piezoelectric actuator comprises a vibration plate, a first electrode, a first piezoelectric layer, a second electrode, a second piezoelectric layer and a third electrode. With respect to a top-bottom direction orthogonal to a surface of the vibration plate, the vibration plate, the first electrode, the first piezoelectric layer, the second electrode, the second piezoelectric layer and the third electrode are stacked in this order. The second piezoelectric layer is narrower than the first piezoelectric layer in a first direction parallel to the surface of the vibration plate. The third electrode extends in the first direction and covers both side surfaces of both of the first piezoelectric layer and the second piezoelectric layer in the first direction.

DETAILED DESCRIPTION

First Embodiment

A first embodiment is described with reference to the accompany drawings.

Structure of Printer

Figure 1:
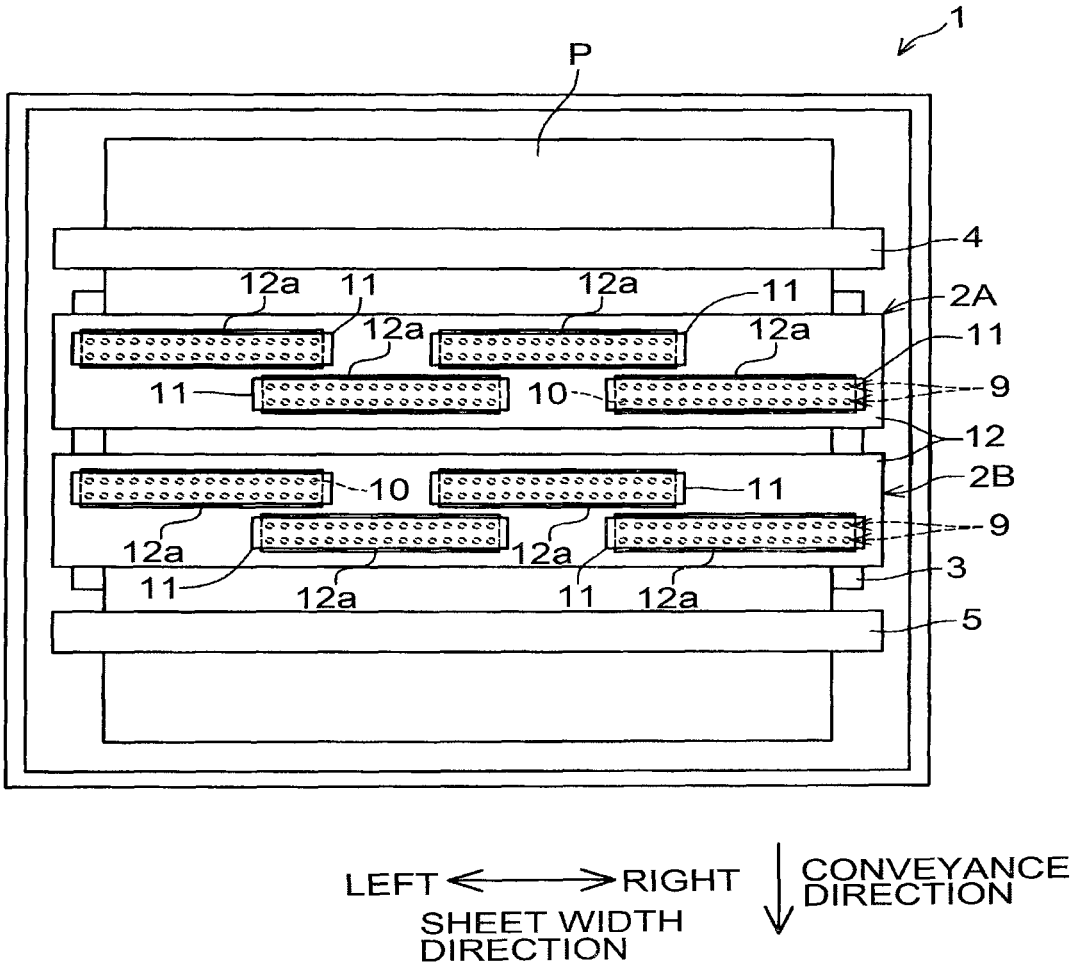
FIG. 1 is a schematic diagram of a printer according to an embodiment of the disclosure.

As illustrated in FIG. 1, a printer 1 according to the first embodiment includes two inkjet heads 2A, 2B, a platen 3, and conveyor rollers 4, 5. The inkjet head 2A and the inkjet head 2B are next to each other in a conveyance direction in which a recording sheet P is conveyed. The inkjet head 2B is downstream from the inkjet head 2A in the conveyance direction. Each of the inkjet heads 2A, 2B includes four head units 11 and a holding member 12.

Each of the head units 11 has nozzles 10 in its lower surface. The nozzles 10 are aligned in nozzle rows 9 in a sheet width direction orthogonal to the conveyance direction. Each of the head units 11 has two nozzle rows 9 next to each other in the conveyance direction (the conveyance direction being bi-directional). Two nozzle rows 9 have the respective nozzles 10 at the same positions in the sheet width direction. The following description is made based on the right and left sides of the printer 1 in the sheet width direction as illustrated in FIG. 1.

The inkjet head 2A ejects an ink, from nozzles 10 in an upstream nozzle row 9 of the two nozzle rows 9 in the conveyance direction, and an ink, from nozzles 10 in a downstream nozzle row 9. The inkjet head 2B ejects an ink from nozzles 10 in an upstream nozzle row 9 of the two nozzle rows 9 in the conveyance direction, and an ink from nozzles 10 in a downstream nozzle row 9.

In each of the inkjet heads 2A, 2B, two of the four head units 11 are spaced apart from each other in the sheet width direction. The two of the four head units 11 aligned in the sheet width direction are spaced apart from the remaining two head units 11 in the conveyance direction. The two upstream head units 11 are offset from the two downstream head units 11 in the sheet width direction. The two upstream head units 11 partially overlap the two downstream head units 11 in the conveyance direction. Thus, the nozzles 10 of the four head units 11 are located throughout the entire length of a recording sheet P in the sheet width direction. Namely, the inkjet heads 2A, 2B are line heads extending along the entire length of a recording sheet P in the sheet width direction.

The holding member 12 is a rectangular plate-like member elongated over the entire length of a recording sheet P in the sheet width direction. The holding member 12 has four through holes 12*a* each corresponding to one of the four head units 11. The nozzles 10 of each of the head units 11 are exposed downward (toward a recording sheet P) via a corresponding one of the through holes 12*a*.

The platen 3 is disposed below the inkjet heads 2A, 2B and faces the nozzles 10 of the inkjet heads 2A, 2B. The platen 3 supports a recording sheet P from below.

The conveyor roller 4 is disposed upstream from the inkjet heads 2A, 2B and the platen 3 in the conveyance direction. The conveyor roller 5 is disposed downstream from the inkjet heads 2A, 2B and the platen 3 in the conveyance direction. The conveyor rollers 4, 5 conveys a recording sheet P in the conveyance direction.

The printer 1 controls the conveyor rollers 4, 5 to convey a recording sheet P in the conveyance direction and the inkjet heads 2A, 2B to eject ink from the respective nozzles 10, thereby recording an image on the recording sheet P.

Head Unit

Figure 2:
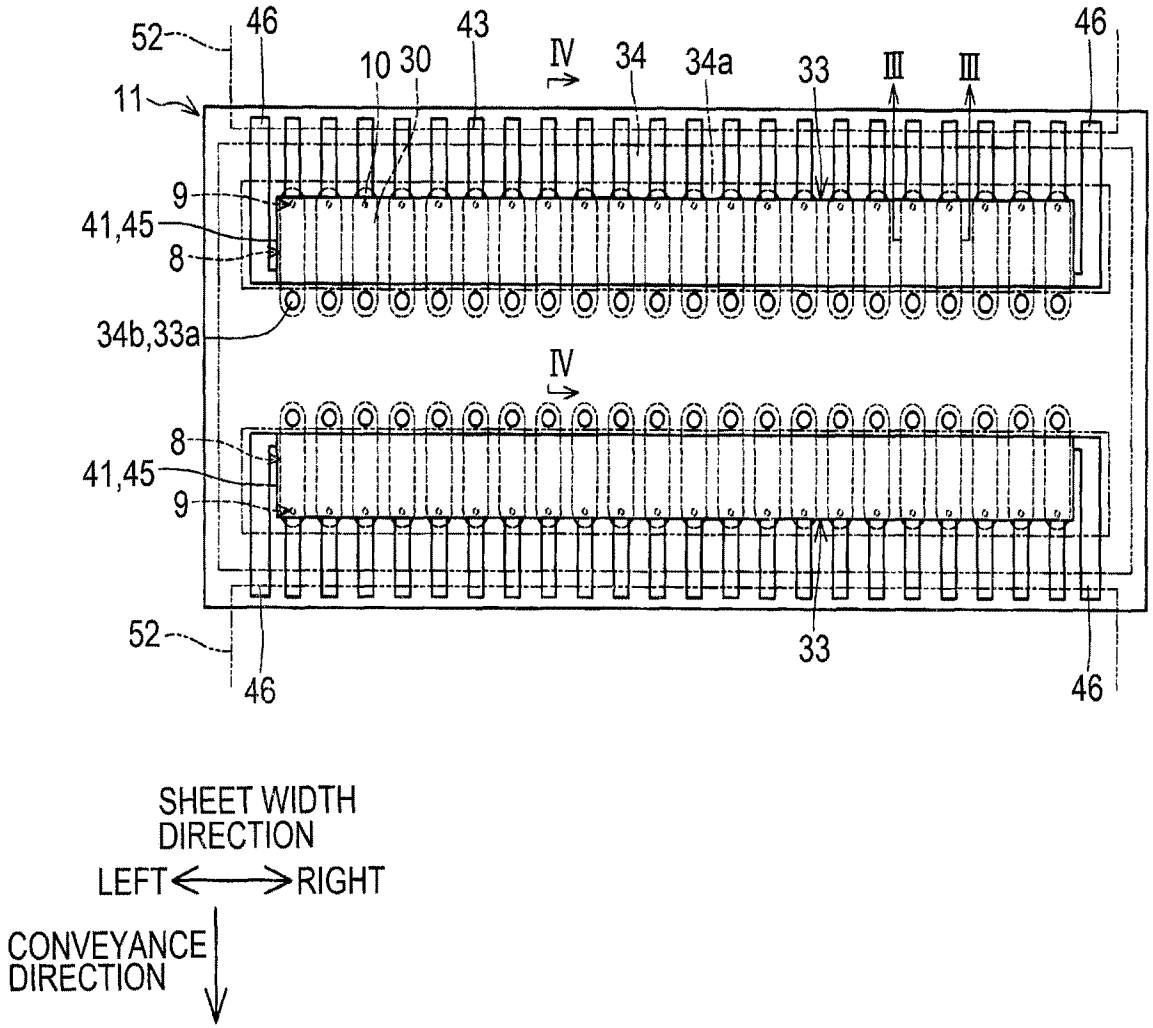
FIG. 2 is a plan view of head units.
Figure 3:
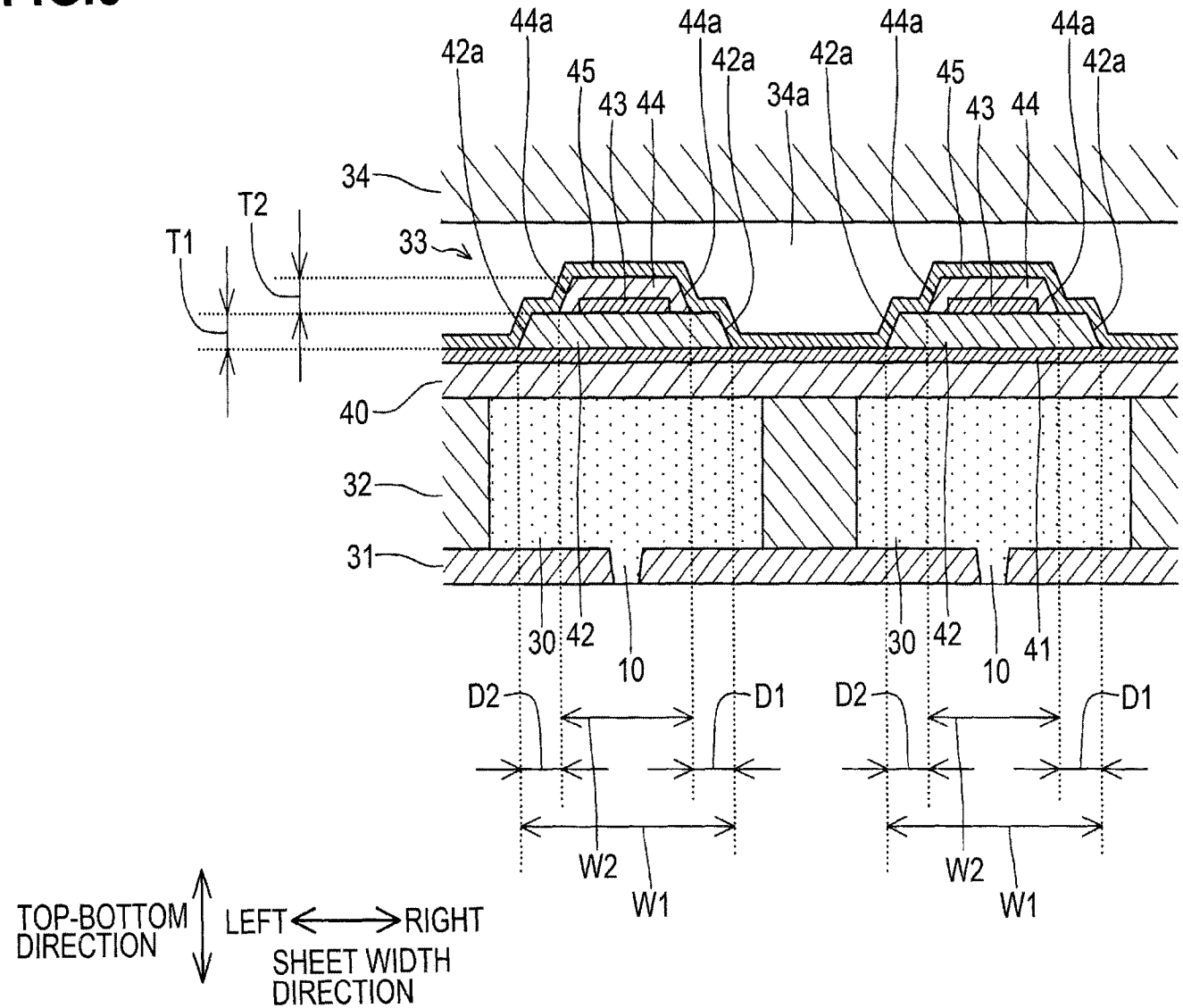
FIG. 3 is a sectional view taken along a line III-III of FIG. 2.
Figure 4:
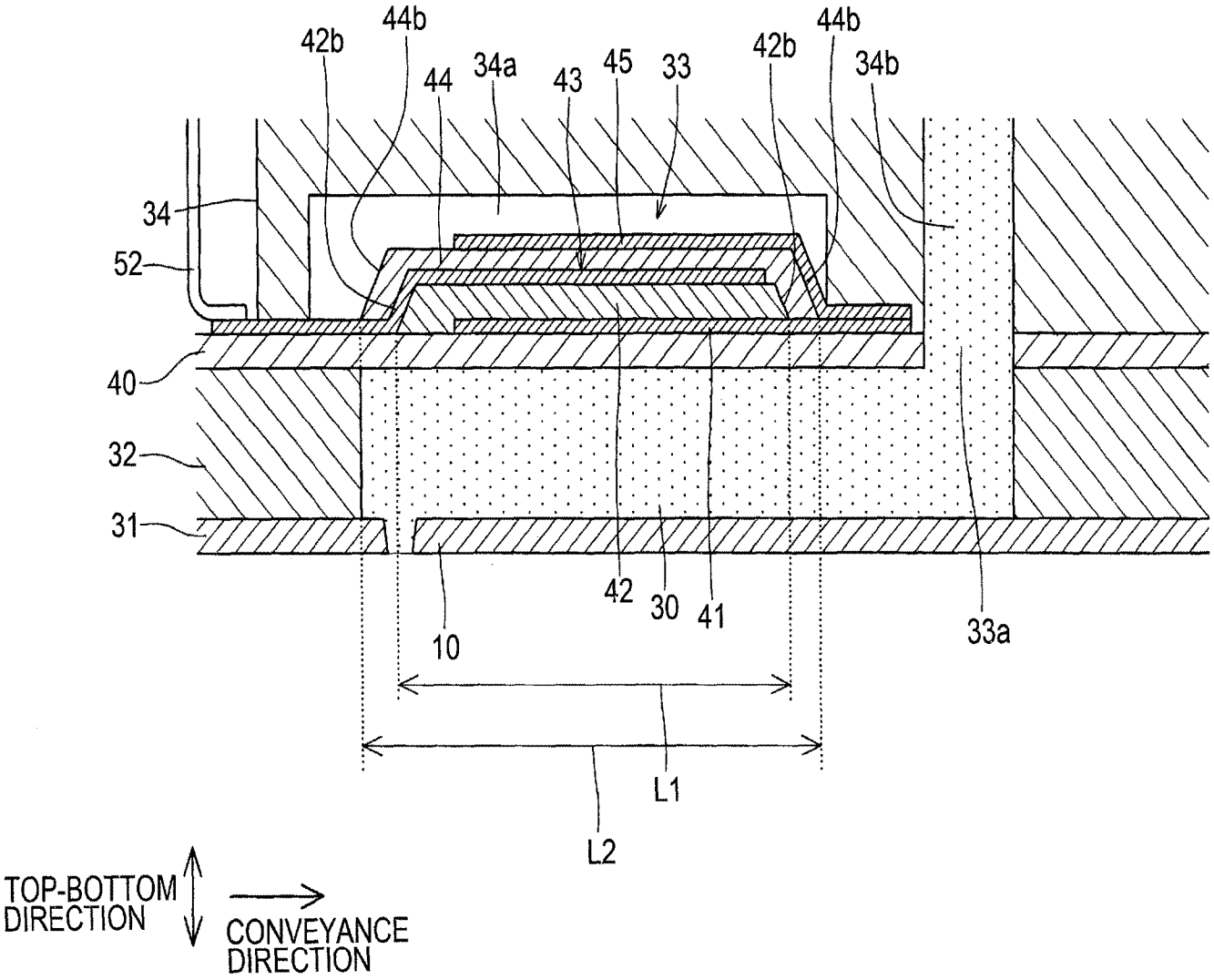
FIG. 4 is a sectional view taken along a line IV-IV of FIG. 2.

As illustrated in FIG. 2, a head unit 11 includes piezoelectric actuators 33 and a protective substrate 34. In FIGS. 3, and 4, a nozzle plate 31, a channel substrate 32, two piezoelectric actuators 33, and the protective substrate 34 are shown.

The nozzle plate 31 is made of a synthetic resin, for example, polyimide. The nozzle plate 31 has nozzles 10 forming the above-described two nozzle rows 9.

The channel substrate 32 can be made of any suitable material such as silicone (Si), Si containing materials, carbon, carbon based materials, metals, and combinations thereof, and disposed on an upper surface of the nozzle plate 31. The channel substrate 32 has a plurality of pressure chambers 30. The pressure chambers 30 are each paired with one of the nozzles 10. Each pressure chamber 30 is elongated in the conveyance direction and has a first end portion in the conveyance direction, which overlaps a corresponding nozzle 10 in the top-bottom direction. The nozzle plate 31 has, thereon, two pressure-chamber rows 8 located next to each other in the conveyance direction, each row including the pressure chambers 30 aligned in the sheet width direction.

In the following description, a first end (portion) and a first side in the conveyance direction may refer to an upstream end (portion) and an upstream side when describing a structure related to an upstream pressure-chamber row 8 in the conveyance direction, and may refer to a downstream end (portion) and a downstream side when describing a structure related to a downstream pressure-chamber row 8 in the conveyance direction.

Two piezoelectric actuators 33, each corresponding to one of the two pressure-chamber rows 8, are disposed on an upper surface of the channel substrate 32 in a top-bottom direction. Each of the piezoelectric actuators 33 includes a vibration plate 40, a first electrode 41 (as an example of a first electrode), a plurality of first piezoelectric members 42, a plurality of middle electrodes 43 (as an example of a second electrode), a plurality of second piezoelectric members 44, and an upper electrode 45 (as an example of a third electrode). The vibration plate 40, the lower electrode 41, the plurality of first piezoelectric members 42, the plurality of middle electrodes 43, the plurality of second piezoelectric members 44 and the upper electrode 45 are stacked in this order with respect to the top-bottom direction.

The vibration plate 40 is common to the two piezoelectric actuators 33, is made of, for example, silicon dioxide (SiO2) or silicon nitride (SiN), and covers upper ends of the pressure chambers 30 forming the two pressure-chamber rows 8. The vibration plate 40 is formed by oxidized or nitrided upper end of the channel substrate 32. The vibration plate 40 has a thickness of, for example, 1 to 2 μm.

The lower electrode 41 is made of, for example, platinum (Pt). The lower electrode 41 is disposed on an upper surface of the vibration plate 40 and extends over the pressure-chamber row 8 including the pressure chambers 30. The lower electrode 41 has a thickness of, for example, 0.1 to 0.2 μm.

The first piezoelectric members 42 are made of a piezoelectric material having, as an ingredient, lead zirconate titanate, which is a mixed crystal of lead titanate and lead zirconate. The first piezoelectric members 42 are each paired with one of pressure chambers 30. Each of the first piezoelectric members 42 is disposed above the vibration plate 40 (as an example of a first side of the vibration plate in a thickness direction). More specifically, each of the first piezoelectric members 42 is disposed on an upper surface of the lower electrode 41, which is disposed on an upper surface of the vibration plate 51. Each of the first piezoelectric members 42 overlaps a corresponding one of the pressure chambers 30 in a top-bottom direction. The first piezoelectric members 42 are arrayed in the sheet width direction as with the pressure chambers 30. Each of the first piezoelectric members 42 has a thickness T1 of, for example, 0.1 μm to 1.0 μm, or about 0.5 μm.

Each of the first piezoelectric members 42 has, in the sheet width direction, end surfaces 42*a* which are inclined relative to the top-bottom direction such that their upper portions are closer to inside of the first piezoelectric member 42 than their lower portions are. Each of the first piezoelectric members 42 has, in the conveyance direction, end surfaces 42*b* (as seen in FIG. 4) which are inclined relative to the top-bottom direction such that their upper portions are closer to inside of the first piezoelectric member 42 than their lower portions are.

Continuing to refer to FIG. 3, the middle electrodes 43 are made of, for example, platinum (Pt) or iridium (Ir). The middle electrodes 43 are each paired with one of the first piezoelectric members 42 and disposed on an upper surface of a corresponding one of the first piezoelectric members 42. Each of the middle electrodes 43 has a thickness of, for example, 0.05 to 0.1 μm.

Each middle electrode 43 extends toward the first side in the conveyance direction and extends to a first end of the channel substrate 32 in the conveyance direction.

The second piezoelectric members 44 are made of the above-described piezoelectric material, being a piezoelectric material having, as an ingredient, lead zirconate titanate, which is a mixed crystal of lead titanate and lead zirconate. The second piezoelectric members 44 are each paired with one of the first piezoelectric members 42. Each of the second piezoelectric members 44 is disposed on an upper surface of a corresponding one of the first piezoelectric members 42 having a middle electrode 43 thereon (or opposite to the vibration plate 40 relative to the corresponding one of the first piezoelectric member 42). The second piezoelectric members 44 are arrayed in the sheet width direction as with the pressure chambers 30 and the first piezoelectric members 44. Each of the second piezoelectric members 44 has a thickness T2 of, for example, 0.5 μm, which is substantially the same as the thickness T1 of the first piezoelectric member 42.

Each of the second piezoelectric members 44 has, in the sheet width direction, end surfaces 44*a* which are inclined relative to the top-bottom direction such that their upper portions are closer to a center of the second piezoelectric member 44 than their lower portions are. Each of the second piezoelectric members 44 has, in the conveyance direction, end surfaces 44*b* which are inclined relative to the top-bottom direction such that their upper portions are closer to a center of the second piezoelectric member 44 than their lower portions are.

The first piezoelectric member 42 extends beyond both side surfaces of the second piezoelectric member 44 in the sheet width direction. Namely, in the sheet width direction, a second piezoelectric member 44 has a dimension W2 smaller than a dimension W1 of a first piezoelectric member 42, with both ends of the second piezoelectric member 44 located between both ends of the first piezoelectric member 42 in the sheet width direction. In other words, in the sheet width direction, a right end of a first piezoelectric member 42 is located to the right further than a right end of a second piezoelectric member 44, and a left end of the first piezoelectric member 42 is located to the left further than a left end of the second piezoelectric member 44. Thus, in the first embodiment, end surfaces 42*a* of the first piezoelectric member 42 in the sheet width direction is uncovered by the second piezoelectric member 44.

The dimension W1 of the first piezoelectric member 42 is, for example, 40 to 50 μm, and the dimension W2 of the second piezoelectric member 44 is, for example, 30 to 40 μm. This embodiment shows that, in the sheet width direction, a distance D1 between a right end of a first piezoelectric member 42 and a right end of a corresponding second piezoelectric member 44 and a distance D2 between a left end of the first piezoelectric member 42 and a left end of the second piezoelectric member 44 are greater than at least one of the thickness T1 of the first piezoelectric member 42 and the thickness T2 of the second piezoelectric member 44. In other words, the first piezoelectric member 42 has a portion with a distance D1, and a portion with a distance D2, in the sheet width direction. If the lengths of D1 and D2 are combined, they result in a distance longer than the second piezoelectric member 44 in the sheet width direction.

The first embodiment shows that the thickness T1 of the first piezoelectric member 42 is substantially the same as the thickness T2 of the second piezoelectric member 44, but the thickness T1 of the first piezoelectric member 42 may be different from the thickness T2 of the second piezoelectric member 44. In this case, the distances D1, D2 are greater than a smaller one of the thickness T1 of the first piezoelectric member 42 and the thickness T2 of the second piezoelectric member 44.

In the conveyance direction, a second piezoelectric member 44 has a dimension L2 greater than a dimension L1 (as seen in FIG. 4) of a corresponding first piezoelectric member 42, and both end surfaces 42*b* of the first piezoelectric member 42 are covered by the second piezoelectric member 44. In other words, the second piezoelectric members 44 covers to both side surface of the first piezoelectric members 42 in the conveyance direction. The first and second piezoelectric members 42, 44 in the conveyance direction are longer than these in the sheet width direction. In detail, the dimension L1 of the first piezoelectric member 42 is, for example, 400 to 500 μm and greater than the dimension W1. The dimension L2 of the second piezoelectric member 44 is, for example, 500 to 600 μm and greater than the dimension W2.

The upper electrode 45 is made of, for example, platinum (Pt) or iridium (Ir). The upper electrode 45 extends in the sheet width direction and covers to both side surface of the first and second piezoelectric members 42, 44 in the sheet width direction. In other words, the upper electrode 45 extends over the second piezoelectric members 44 in the sheet width direction, and covers upper surfaces of the second piezoelectric members 44, end surfaces 44*a* of the second piezoelectric members 44 in the sheet width direction, portions of upper surfaces of the first piezoelectric members 42 protruding outward from the second piezoelectric members 44 in the sheet width direction, and end surfaces 42*a* of the first piezoelectric members 42 in the sheet width direction.

The upper electrode 45 extends toward a second side in the conveyance direction further than the first piezoelectric member 42 and the second piezoelectric member 44 and overlaps the lower electrode 41 in the top-bottom direction. Thus, the lower electrode 41 and the upper electrode 45 are electrically conductive. The upper electrode 45 has a thickness of, for example, 0.05 to 0.1 μm.

In the following description, a second end (portion) and a second side in the conveyance direction may refer to a downstream end (portion) and a downstream side when describing a structure related to an upstream pressure-chamber row 8 in the conveyance direction, and may refer to an upstream end (portion) and an upstream side when describing a structure related to a downstream pressure-chamber row 8 in the conveyance direction.

Each of the piezoelectric actuators 33 has a plurality of supply holes 33*a* each at a portion overlapping, in the top-bottom direction, a second end portion of a corresponding pressure chamber 30 in the conveyance direction. The supply holes 33*a* pass through the vibration plate 40, the lower electrode 41 and the upper electrode 45 in the top-bottom direction.

The protective substrate 34 can be made of any suitable material such as silicone (Si), Si containing materials, carbon, carbon based materials, metals, and combinations thereof, and disposed above the channel substrate 32 having the piezoelectric actuators 33 on its upper surface. The protective substrate 34 has a lower surface with two recessed portions 34*a*, which are open downward. Each of the two recessed portions 34*a* corresponds to one of the two pressure-chamber rows 8*a* and extends in the sheet width direction such that the protective substrate 34 covers the first piezoelectric members 42 and the second piezoelectric members 44, which correspond to the pressure chambers 30 in each of the pressure-chamber rows 8.

The protective substrate 34 has a plurality of supply channels 34*b* extending and overlapping the respective supply holes 33*a* in the top-bottom direction. Each supply channel 34*b* is connected at its lower end to the supply hole 33*a* and at its upper end to a manifold, which is not illustrated. This allows ink to flow from the manifold through the supply channels 34*b* and the supply holes 33*a* to the pressure chambers 30.

The first embodiment shows that portions of the middle electrodes 43, which are located toward the first side in the conveyance direction further than the protective substrate 34, are exposed. The exposed portions of the middle electrodes 43 are connected to a wiring member 52, and the middle electrodes 43 are thus connected via the wiring member 52 to a driver IC, which is not illustrated. The driver IC selectively provides a ground potential or a specified drive potential (e.g., 20V) to each of the middle electrodes 43.

As illustrated in FIG. 2, wiring portions 46 are disposed on the upper surface of the vibration plate 40. Each of the wiring portions 46 is connected to a corresponding end portion, in the sheet width direction, of both of a lower electrode 41 and an upper electrode 45, which overlap each other in the top-bottom direction. The wiring portions 46 extend toward the first side in the conveyance direction. The wiring portions 46 extend to a first end of the channel substrate 32 in the conveyance direction. The wiring portions 46 are connected to a wiring member 52 at their end portions opposite to those connected to the electrodes 41, 43. The lower electrode 41 and the upper electrode 45 are thus connected via the wiring member 52 to a power source, which is not illustrated, and maintained at the ground potential.

The following describes a method of ejecting ink from nozzles 10 by driving a piezoelectric actuator 33. The piezoelectric actuator 33 maintains all the middle electrodes 43 it the ground potential, as well as the lower electrode 41 and the upper electrode 45. In ejecting ink from a nozzle 10, the potential for a middle electrode 43 corresponding to the nozzle 10 changes from the ground potential to the drive potential. This creates electric fields in a thickness direction in an active portion of a first piezoelectric member 42 disposed between the lower electrode 41 and the middle portion 43 and an active portion of a second piezoelectric member 44 disposed between the middle electrode 43 and the upper electrode 45. The electric fields cause the active portion of the first piezoelectric member 42 and the active portion of the second piezoelectric member 44 to deform and shrink horizontally. In response to this horizontal shrink, portions of the first piezoelectric member 42 and the second piezoelectric member 44, which overlap, in the top-bottom direction, become deformed and cause a portion of the vibration plate 40 between portions of channel substrate 32 in the sheet width direction, to protrude into the pressure chamber 30. The pressure chamber 30 is thus reduced in volume and the pressure of ink in the pressure chamber 30 rises, so that ink is ejected from the nozzle 10 communicating with the pressure chamber 30. After ink is ejected from the nozzle 10, the potential of the middle electrode 43 returns to the ground potential.

Head Unit Manufacturing Method

The following describes a method of manufacturing a head unit 11 including a piezoelectric actuator 33. Although, at a manufacture stage, a head unit 11 is not assembled to the printer 1, the following description uses the directions based on the printer 1 such as the sheet width direction, the conveyance direction, and the top-bottom direction, to describe the head unit 11 for convenience sake.

Figure 5A:
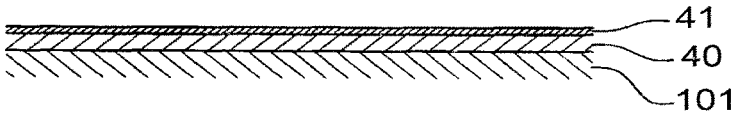
FIG. 5A illustrates a process for forming a lower electrode, corresponding to a portion of FIG. 3.
Figure 6A:
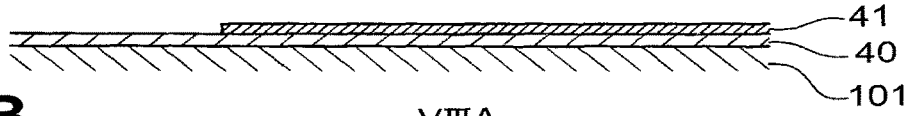
FIG. 6A illustrates a process for forming the lower electrode, corresponding to a portion of FIG. 4.

As illustrated in FIGS. 5A and 6A, manufacture of a head unit 11 may start by forming a lower electrode 41 on an upper surface of a vibration plate 40 in the top-bottom direction, which is formed by oxidizing or nitriding an upper surface of a base substrate 101 for a channel substrate 32. (This a first electrode forming process.)

Figure 5B:
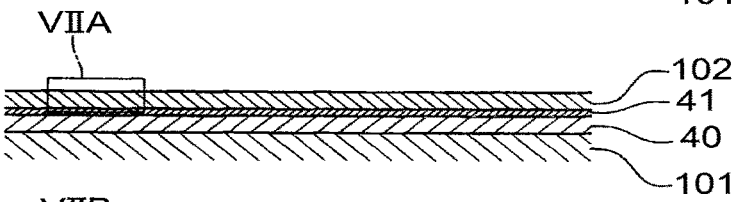
FIG. 5B illustrates a process for forming a first layer, corresponding to a portion of FIG. 3.
Figure 6B:
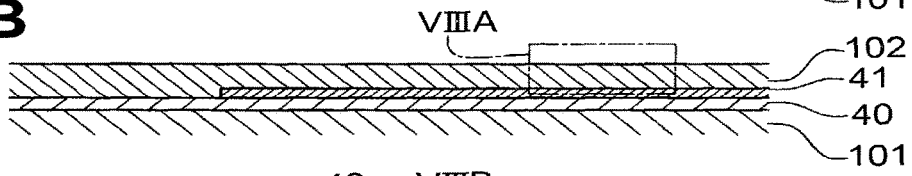
FIG. 6B illustrates a process for forming the first layer, corresponding to a portion of FIG. 4.

As illustrated in FIGS. 5B and 6B, a first layer 102 is formed on an upper surface of the lower electrode 41 using the sol-gel process. (This is a first layer forming process.) The first layer 102 is a layer of a piezoelectric material, for forming first piezoelectric members 42. A spin coating method can be used to apply the piezoelectric material. Formation of the first layer 102 and the second layer 103 using the sol-gel method is described later.

Figure 5C:
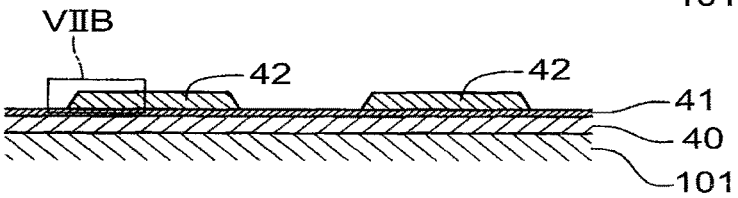
FIG. 5C illustrates a process for forming first piezoelectric members using etching, corresponding to a portion of FIG. 3.
Figure 5D:
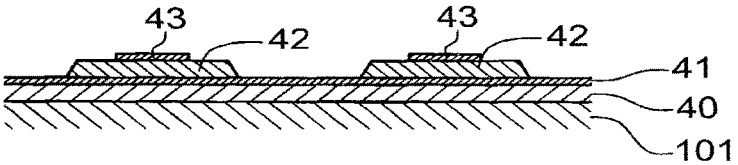
FIG. 5D illustrates a process for forming middle electrodes, corresponding to a portion of FIG. 3.
Figure 6C:
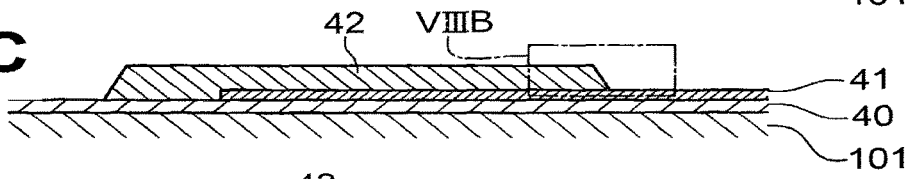
FIG. 6C illustrates a process for forming the first piezoelectric member using etching, corresponding to a portion of FIG. 4.
Figure 6D:
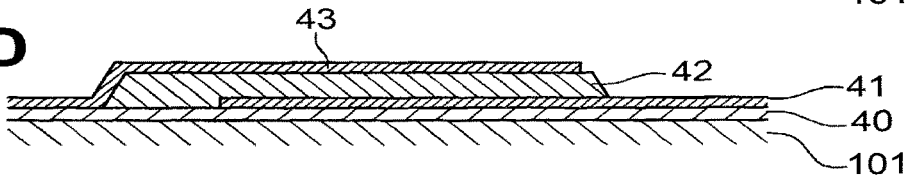
FIG. 6D illustrates a process for forming the middle electrode, corresponding to a portion of FIG. 4.

As illustrated in FIGS. 5C and 6C, first piezoelectric members 42 are formed by etching the first layer 102. (This is a first etching process.) As illustrated in FIGS. 5D and 6D, middle electrodes 43 are formed on upper surfaces of the first piezoelectric members 42. (This is a second electrode forming process.)

Figure 5E:
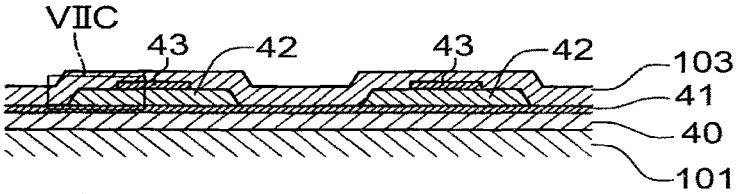
FIG. 5E illustrates a process for forming a second layer, corresponding to a portion of FIG. 3.
Figure 5F:
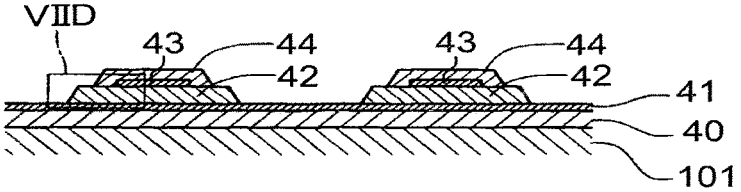
FIG. 5F illustrates a process for forming second piezoelectric members, corresponding to a portion of FIG. 3.
Figure 6E:
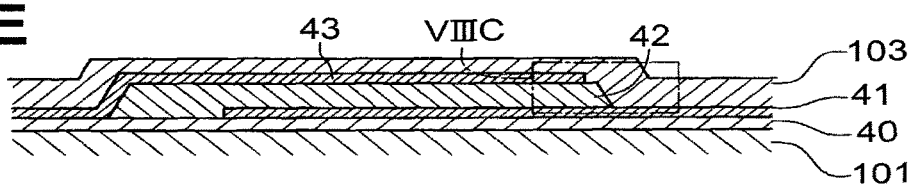
FIG. 6E illustrates a process for forming the second layer, corresponding to a portion of FIG. 4.
Figure 6F:
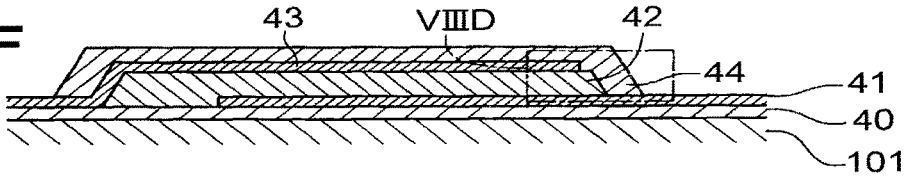
FIG. 6F illustrates a process for forming the second piezoelectric member, corresponding to a portion of FIG. 4.

As illustrated in FIGS. 5E and 6E, a second layer 103 of a piezoelectric material is formed on upper surfaces of the lower electrode 41, the first piezoelectric members 42, and the middle electrodes 43 by using the sol-gel method to cover them. (This is a second layer forming process.) The second layer 103 is a layer of the piezoelectric material for forming second piezoelectric members 44. The spin coating method is used to apply the piezoelectric material. As illustrated in FIGS. 5F and 6F, second piezoelectric members 44 are formed by etching the second layer 103. (This is a second etching process.)

Figure 5G:
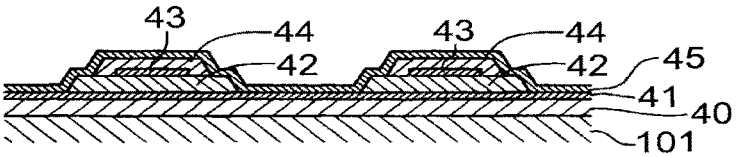
FIG. 5G illustrates a process for forming an upper electrode, corresponding to a portion of FIG. 3.
Figure 5G:
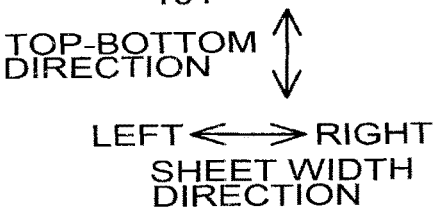
Figure 6G:
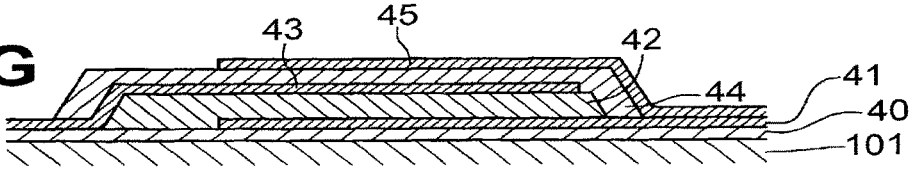
FIG. 6G illustrates a process for forming the upper electrode, corresponding to a portion of FIG. 4.
Figure 6G:
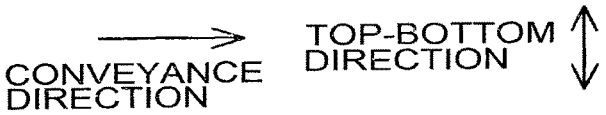

As illustrated in FIGS. 5G and 6G, an upper electrode 45 is formed covering the lower electrode 41, the first piezoelectric members 42, and the second piezoelectric members 44. (This is a third electrode forming process.) Thus, the piezoelectric actuator 33 of the head unit 11 is completed. In other words, the upper electrode 45 is formed on the second piezoelectric members 42 covering the middle electrodes 43. Then, a protective substrate 34 is joined over the base substrate 101. The base substrate 101 is etched to form a channel substrate 32 with pressure chambers 30. The channel substrate 32 has a lower surface to which a nozzle plate 31 is joined. Thus, the head unit 11 is completed.

Formation of First and Second Layers Using Sol-Gel Method

Formation of the first layer 102 and the second layer 103 using the so-gel method is described. The first embodiment shows that, to form a layer of piezoelectric material using the sol-gel method, the piezoelectric material is applied using the spin coating method to form a thin film of piezoelectric material. Through repeated applying of the piezoelectric material, thin films of the piezoelectric material are stacked to form the first layer 102 and the second layer 103.

A predetermined number of the thin films of the piezoelectric material are stacked before annealing. The first layer 102 and the second layer 103 thus have boundaries, respectively, each of which is a topmost surface of the stacked thin films of the piezoelectric material at the annealing.

As described above, the first layer 102 is formed on the upper surface of the lower electrode 41. This surface is planar and parallel to the sheet width direction and the conveyance direction, and thus the stacked thin films constituting the first layer 102 extend parallel to the sheet width direction and the conveyance direction.

Figure 7A:
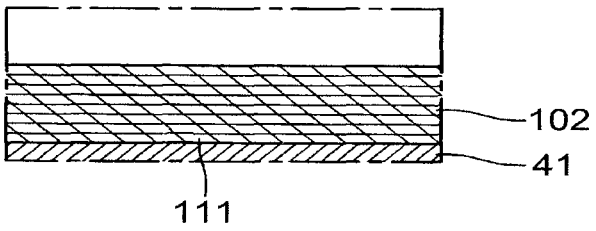
FIG. 7A is an enlarged view of a portion VIIA of FIG. 5B.
Figure 7B:
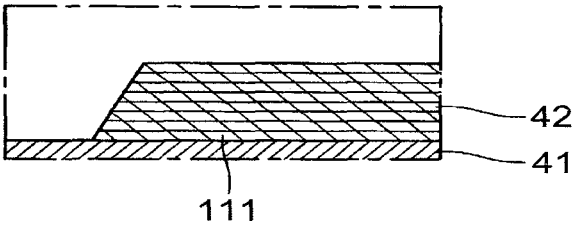
FIG. 7B is an enlarged view of a portion VIIB of FIG. 5C.
Figure 8A:
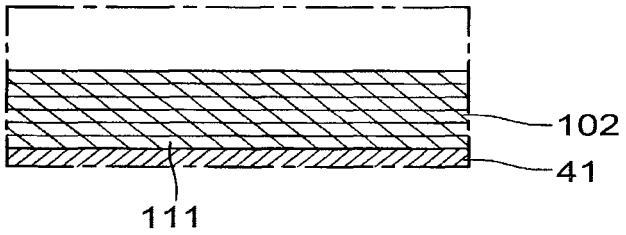
FIG. 8A is an enlarged view of a portion VIIIA of FIG. 6B.
Figure 8B:
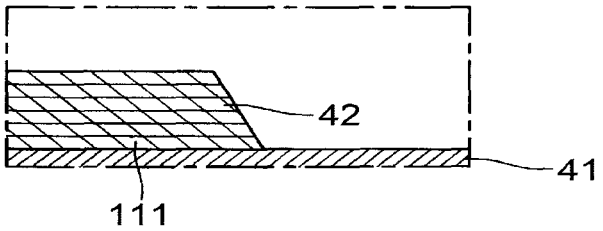
FIG. 8B is an enlarged view of a portion VIIIB of FIG. 6C.

As illustrated in FIGS. 7A and 7B, the films 111 in the first layer 102 extend in the sheet width direction and the conveyance direction. As illustrated in FIGS. 7B and 8B, the films 111 extend in the sheet width direction and the conveyance direction in a first piezoelectric member 42 formed by etching the first layer 102.

The second layer 103 is formed on the upper surfaces of the lower electrode 41, the first piezoelectric members 42, and the middle electrodes 43. The second layer 103 has an uneven surface having a portion where the middle electrode 43 is located and a portion where the middle electrode 43 is not located.

Figure 7C:
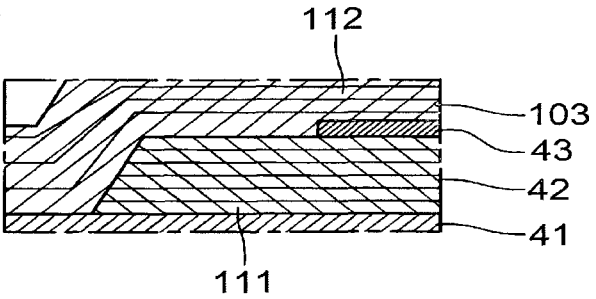
FIG. 7C is an enlarged view of a portion VIIC of FIG. 5E.
Figure 8C:
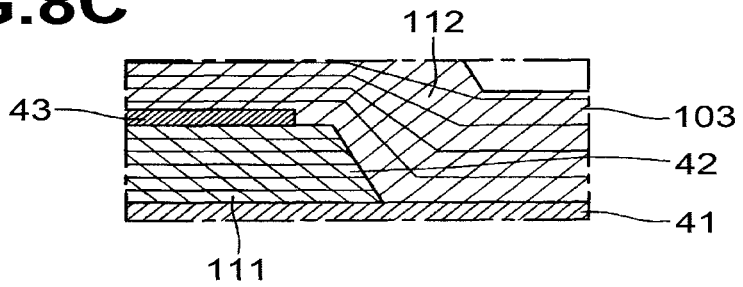
FIG. 8C is an enlarged view of a portion of VIIIC of FIG. 6E.

As illustrated in FIGS. 7C and 8C, the films 112 in the second layer 103 extend in the sheet width direction and the conveyance direction at portions covering the upper surface of the first piezoelectric member 42 and the lower electrode 41.

The boundaries formed in the second layer 103 at annealing extend along with a surface of the first layer 103 and the base substrate 101. In other words, the films 112 in the second layer 103 are inclined relative to the sheet width direction at portions covering the end surface 42*a* of the first piezoelectric member 42 (as seen in FIG. 3). The films 112 in the second layer 103 are inclined relative to the conveyance direction at portions covering the end surface 42*b* of the first piezoelectric member 42 (as seen in FIG. 3).

Figure 7D:
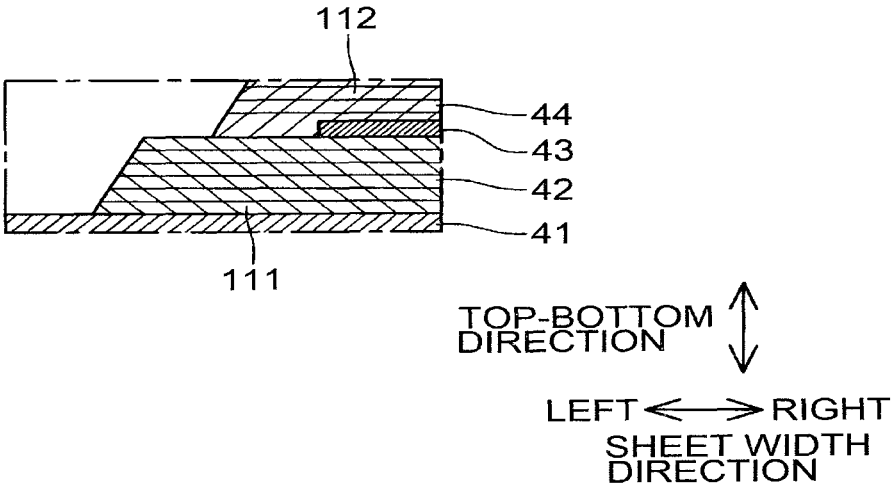
FIG. 7D is an enlarged view of a portion VIID of FIG. 5F.
Figure 8D:
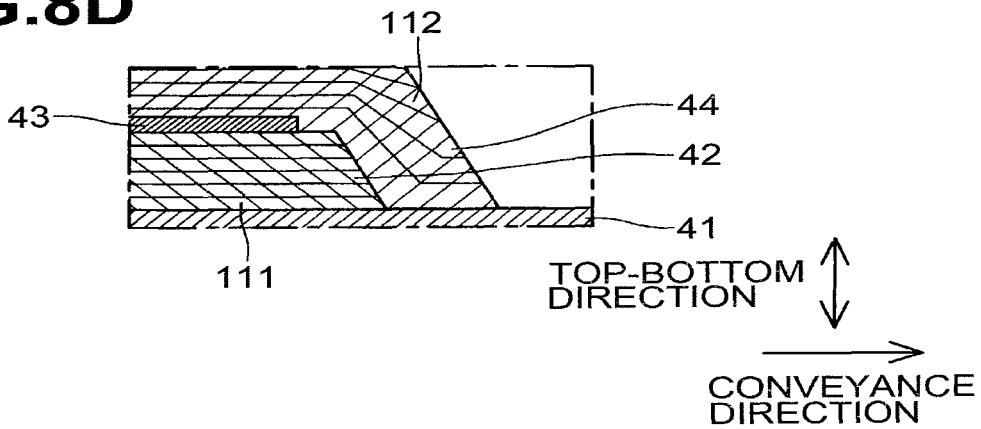
FIG. 8D is an enlarged view of a portion VIIID of FIG. 6F.

As illustrated in FIGS. 7D and 8D, the films 112 in the second piezoelectric member 44 formed by etching the second layer 103 extend in the sheet width direction and the conveyance direction at portions covering the upper surface of the first piezoelectric member 42, and are inclined relative to the sheet width direction at portions covering the end surface 42*a* of the first piezoelectric member 42, and are inclined relative to the conveyance direction at portions covering the end surface 42*b* of the first piezoelectric member 42.

Effects

The first embodiment shows that, in the sheet width direction, both ends of a second piezoelectric member 44 are located between both ends of a corresponding first piezoelectric member 42. The second piezoelectric member 44 has no portions covering the end surfaces 42*a* of the first piezoelectric member 42 in the sheet width direction. Thus, the piezoelectric actuator 33 has a reduced size in the sheet width direction, compared with a piezoelectric actuator of which second piezoelectric member would have portions covering the end surfaces 42*a* of the first piezoelectric member 42 in the sheet width direction.

Unlike the first embodiment, if the second piezoelectric member has portions covering the end surfaces 42*a* of the first piezoelectric member 42 in the sheet width direction, the portions of the second piezoelectric member would be inactive portions that do not deform piezoelectrically when a difference is generated in electric potential between the middle electrode 43, the lower electrode 41, and the upper electrode 45. When the actuator 33 is driven, the inactive portions would impede the deformation of the vibration plate 40, the first piezoelectric member 42, and the second piezoelectric member 44. In the first embodiment, however, the second piezoelectric member 44 has no portions covering the end surfaces 42*a* of the first piezoelectric member 42 in the sheet width direction, thus increasing efficiency to deform the piezoelectric actuator 33.

In this case, the end surfaces 42*a* of the first piezoelectric member 42 are covered and protected by the upper electrode 45.

The first embodiment shows that the middle electrode 43 extends toward the first side in the conveyance direction and the upper electrode 45 extends toward the second side in the conveyance direction. This prevents short circuits between the middle electrode 43 and the upper electrode 45.

The first embodiment shows that the second ends of the first piezoelectric member 42 and the second piezoelectric member 44 are located toward the second side in the conveyance direction further than the second end of the middle electrode 43. The second end of the middle electrode 43 in the conveyance direction is not exposed to a boundary between the second end surface 42*b* of the first piezoelectric member 42 and the second end surface 44*b* of the second piezoelectric member 44. This prevents short circuits between the middle electrode 43 and the upper electrode 45.

The first piezoelectric members 42 of the piezoelectric actuator 33 have a dimension greater in the conveyance direction than in the sheet width direction. Covering the end surfaces 42*b* of the first piezoelectric members 42 in the conveyance direction reduces impediments to the deformation of the piezoelectric actuator 33 further than covering the end surfaces 42*a* thereof in the sheet width direction. In the first embodiment, the second piezoelectric members 44 cover the end surfaces 42*b* of the first piezoelectric members 42 in the conveyance direction. This minimizes impediments to the deformation of the piezoelectric actuator and uses the second piezoelectric members 44 to maintain, in the conveyance direction, the ends of the middle electrodes 43 away from portions of the upper electrode 45 located on the end surfaces 44*b* of the second piezoelectric member 44, thus preventing short circuits between the middle electrodes 43 and the upper electrode 45.

When the sol-gel method is used to form the first layer 102, from which the first piezoelectric members 42 are formed, and the second layer 103, from which the second piezoelectric members 44 are formed, the films 1 in the first piezoelectric members 42 extend in the sheet width direction and the conveyance direction. The films 112 extend in the sheet width direction and the conveyance direction at a portion of the second piezoelectric member 44 overlapping the first piezoelectric member 42 in the top-bottom direction. The films 112 are inclined relative to the sheet width direction at a portion covering an end surface 42*a* of the first piezoelectric member 42. The films 112 are inclined relative to the conveyance direction at a portion covering the end surface 42*b* of the first piezoelectric member 42.

The upper electrode 45 is formed by layering films on the first piezoelectric members 42 and the second piezoelectric members 44 from above. In a case that is different than the first embodiment, if the end surfaces 42*a*, 44*a* are parallel to the top-bottom direction, layering films on the end surfaces 42*a*, 44*a* from above will become difficult. In the first embodiment, however, the end surfaces 42*a* of the first piezoelectric members 42 in the sheet width direction and the end surfaces 44*a* of the second piezoelectric members 44 in the sheet width direction are inclined relative to the top-bottom direction. This facilitates layering films on the end surfaces 42*a* of the first piezoelectric members 42 and the end surfaces 44*a* of the second piezoelectric members 44 from above to form the upper electrode 45 covering the end surfaces 42*a*, 44*a*.

In the first embodiment, the lower electrode 41 continuously extends over the first piezoelectric members 42 associated with the pressure chambers 30 forming the two pressure-chamber rows 8. In other words, the piezoelectric actuator 33 includes a first piezoelectric layer 42 and another piezoelectric actuator 33' includes an another first piezoelectric layer 42. The lower electrode 41 continuously extends across both the first piezoelectric layer 42 of piezoelectric actuator 33 and the another first piezoelectric layer 42 of piezoelectric actuator 33'. Thus, the lower electrode 41 has a large area and small electric resistance. This enables the lower electrode 41 and the upper electrode 45 to be maintained at a ground potential.

In manufacturing the head unit 11 including the piezoelectric actuators 33, the first layer 102 and the second layer 103 are etched at different times, thus manufacturing the actuator 33 such that the end surfaces 42*a* of the first piezoelectric members 42 and the end surfaces 44*a* of the second piezoelectric members 44 are at different positions in the sheet width direction and the conveyance direction. In this case, the first layer 102 is etched so that a middle electrode 43 is formed, and then the second layer 103 is formed and etched. As the second layer 103 covers a first end portion of the middle electrode 43 in the conveyance direction, which is located to the second side in the conveyance direction further than an end surface 42*b* of the first piezoelectric member 44, the first end portion of the middle electrode 43 can be prevented from being dissolved when the second layer 103 is etched. This eliminates formation of a separate wiring portion to be connected to the middle electrode 43.

Second Embodiment

A second embodiment is described. The second embodiment uses a piezoelectric actuator 150 different in structure from the piezoelectric actuator 33 of the first embodiment. The following describes the piezoelectric actuator 150 mainly. Components similar to or identical with, in structure, those illustrated and described in the first embodiment are designated by similar numerals, and thus the description thereof can be omitted from the sake of brevity.

Figure 9:
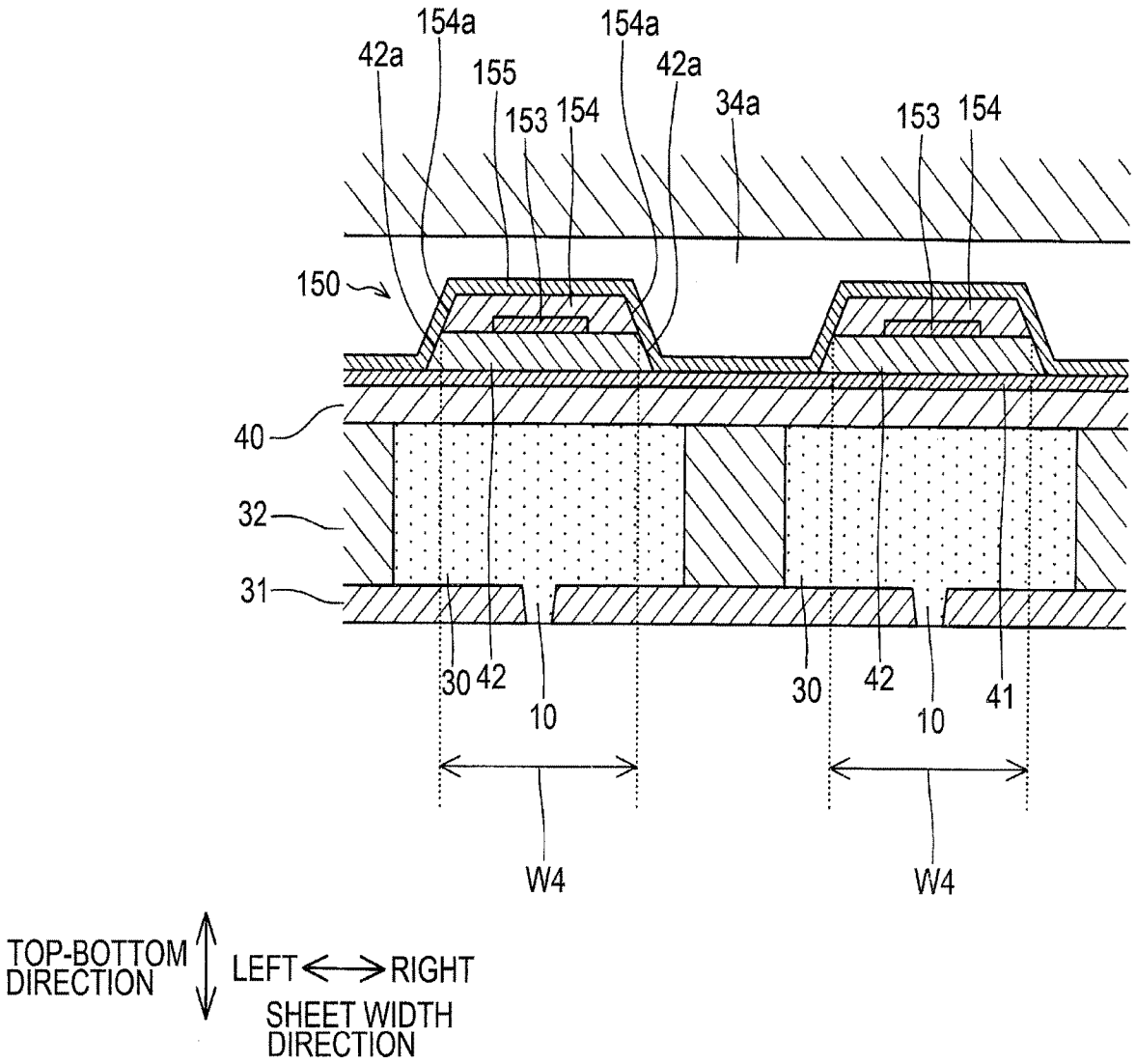
FIG. 9 is a sectional view of a head unit according to a second embodiment, corresponding to FIG. 3.
Figure 10:
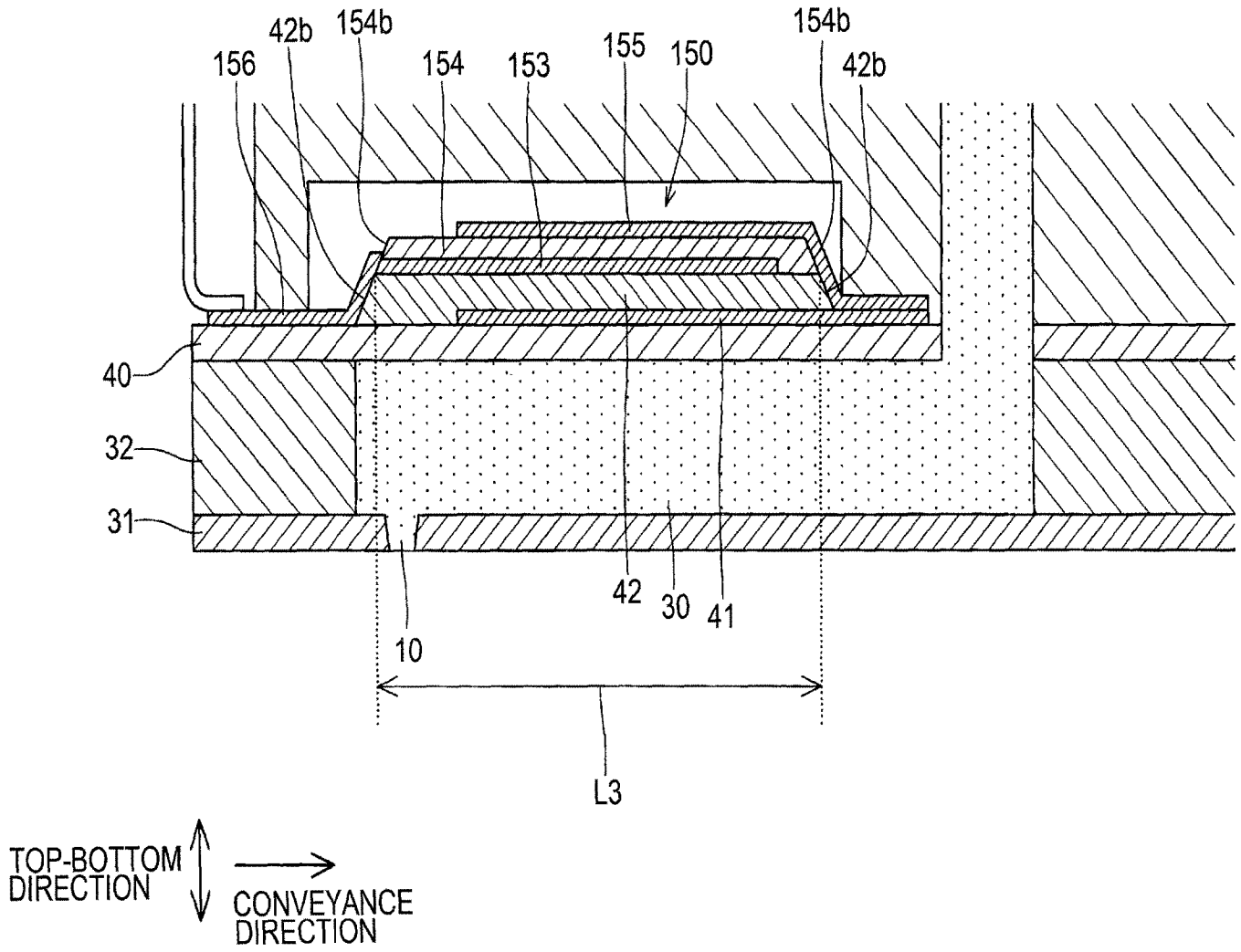
FIG. 10 is a sectional view of the head unit according to the second embodiment, corresponding to FIG. 4.

As illustrated in FIGS. 9 and 10, the piezoelectric actuator 150 includes a vibration plate 40, a lower electrode 41, a plurality of first piezoelectric members 42, which are similar to those in the first embodiment, a plurality of middle electrodes 153, a plurality of second piezoelectric members 154, and an upper electrode 155.

Figure 11:
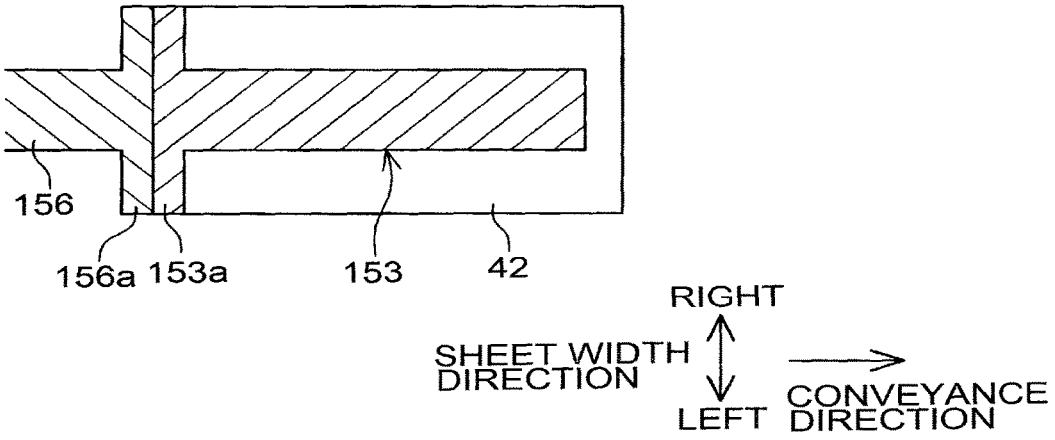
FIG. 11 is a top view of a first piezoelectric member of FIG. 10.

The middle electrodes 153 are each paired with one of the first piezoelectric members 42. Each of the middle electrodes 153 is disposed on an upper surface of a corresponding one of the first piezoelectric members 42. The middle electrodes 153 extend to a first end of the upper surface of the first piezoelectric member 42 in the conveyance direction. As illustrated in FIG. 11, the middle electrode 153 has a wide portion 153*a*, which is located at a position corresponding to the first end of the upper surface of the first piezoelectric member 42. The wide portion 153*a* is wider in the sheet width direction than all other portions of the middle electrode 153. For example, the width of the wide portion 153*a* is 40 to 60 μm. The width of other portions is 20 to 30 μm.

The second piezoelectric members 154 are each paired with one of the first piezoelectric members 42. Each of the second piezoelectric members 154 is disposed on an upper surface of a corresponding one of the first piezoelectric members 42. The second piezoelectric members 154 in the sheet width direction is as wide as the first piezoelectric members 42 in the conveyance direction. In other words, the upper surface of a first piezoelectric member 42 and the lower surface of a corresponding second piezoelectric member 154 have the same dimension W4. Thus, the end surfaces 42*a* of the first piezoelectric member 42 in the sheet width direction are contiguous with the end surfaces 154*a* of the second piezoelectric members 154 in the sheet width direction.

The second piezoelectric members 154 in the conveyance direction is as wide as the first piezoelectric members 42 in the conveyance direction. In other words, the upper surface of a first piezoelectric member 42 and the lower surface of a corresponding second piezoelectric member 154 have the same length L3 (>W4). Thus, the end surfaces 42*b* of the first piezoelectric member 42 in the conveyance direction are contiguous with the end surfaces 154*b* of the second piezoelectric members 154 in the conveyance direction. The middle electrode 153 has an end portion of the first side in the conveyance direction orthogonal to both the thickness and sheet width direction. The middle electrode 153 at end portion is wider than the middle electrode 153 at other portions. In other words, the wide portion 153*a* of the middle electrode 153 is exposed at a boundary between the first end surface 42*b* of the first piezoelectric member 42 and the first end surface 154*b* of the second piezoelectric member 154 in the conveyance direction.

The piezoelectric actuator 150 includes a wiring portion 156. The wiring portion 156 is connected to the exposed end of the wide portion 153*a* of the middle electrode 153, and extends along the first end surfaces 42*b* and 154*b* of the first piezoelectric member 42 and the second piezoelectric member 154 in the conveyance direction and the upper surface of the vibration plate 40, to the first end of the channel substrate 32 in the conveyance direction. As illustrated in FIG. 11, while the middle electrode 153 includes the wide portion 153*a*, the wiring portion 156 includes a wide portion 156*a*, which is wider in the sheet width direction than other portions thereof, at an end connected to the middle electrode 153 and is the same width as the wide portion 153*a* of the middle electrode 153.

The upper electrode 155 extends in the sheet width direction and covers to both side surface of the first and second piezoelectric members 42,154 in the sheet width direction. In detail, the upper electrode 155 extends in the sheet width direction and covers upper surfaces of the second piezoelectric members 154, end surfaces 154*a* of the second piezoelectric members 154 in the sheet width direction, and end surfaces 42*a* of the first piezoelectric members 42 in the sheet width direction. The upper electrode 155 extends toward the second side in the conveyance direction further than the first piezoelectric member 42 and the second piezoelectric member 154 and overlaps the lower electrode 41 in the top-bottom direction. Thus, the lower electrode 41 and the upper electrode 45 are electrically conductive.

The following describes a method of manufacturing a head unit including a piezoelectric actuator 150.

Figure 12A:
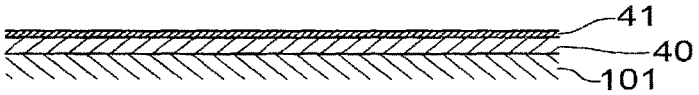
FIG. 12A illustrates a process for forming a lower electrode, corresponding to a portion of FIG. 9.
Figure 13A:
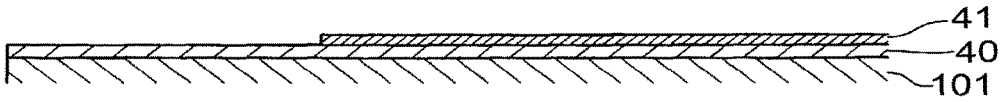
FIG. 13A illustrates a process for forming the lower electrode, corresponding to a portion of FIG. 10.

As illustrated in FIGS. 12A and 13A, manufacture of a head unit may start by forming a lower electrode 41 on an upper surface of a vibration plate 40, which is formed by oxidizing or nitriding an upper surface of a base substrate 101 for a channel substrate 32. (This is a first electrode forming process.)

Figure 12B:
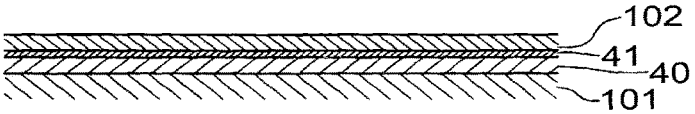
FIG. 12B illustrates a process for forming a first laver, corresponding to a portion of FIG. 9.
Figure 13B:
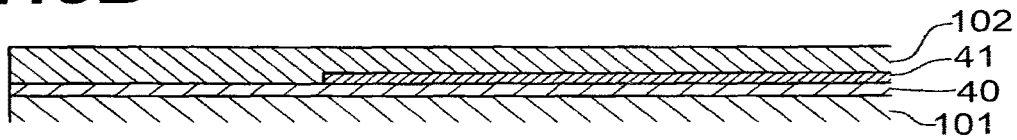
FIG. 13B illustrates a process for forming a first layer, corresponding to a portion of FIG. 10.

As illustrated in FIGS. 12B and 13B, a first layer 102 is formed on an upper surface of the lower electrode 41 using the sol-gel process (described above in reference to FIGS. 5A-5G and 6A-6G). (This is a first layer forming process.) The first layer 102 is a layer of a piezoelectric material, for forming first piezoelectric members 42. The spin coating method is used to apply the piezoelectric material.

Figure 12C:
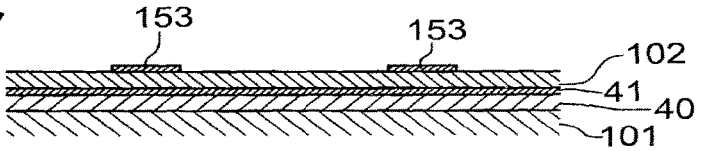
FIG. 12C illustrates a process for forming middle electrodes, corresponding to a portion of FIG. 9.
Figure 13C:
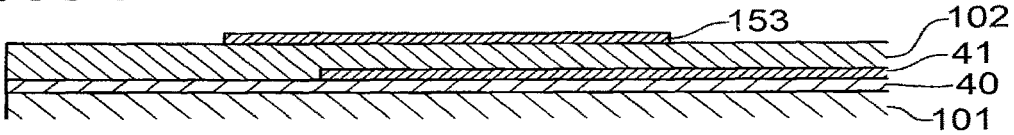
FIG. 13C illustrates a process for forming the middle electrodes, corresponding to a portion of FIG. 10.

As illustrated in FIGS. 12C and 13C, middle electrodes 153 are formed on upper surfaces of the first piezoelectric members 42. (This is a second electrode forming process.) The middle electrode 153 overlaps the lower electrode 41.

Figure 12D:
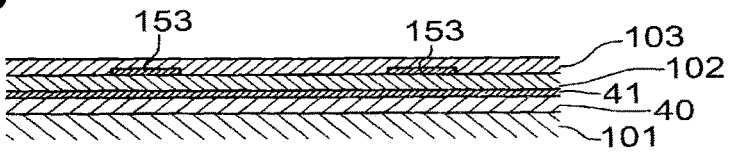
FIG. 12D illustrates a process for forming a second layer, corresponding to a portion of FIG. 9.
Figure 12E:
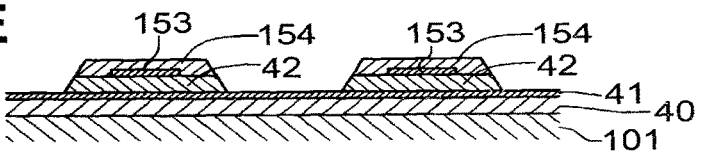
FIG. 12E illustrates a process for forming first piezoelectric members and second piezoelectric members using etching, corresponding to a portion of FIG. 9.
Figure 13D:
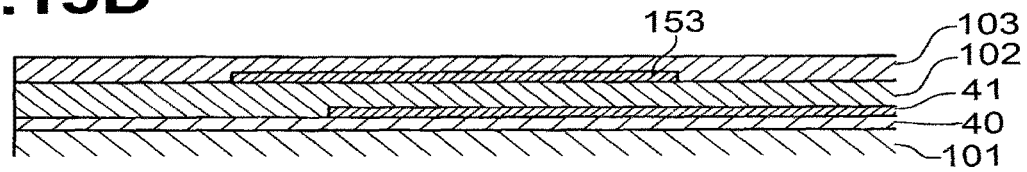
FIG. 13D illustrates a process for forming the second layer, corresponding to a portion of FIG. 10.
Figure 13E:
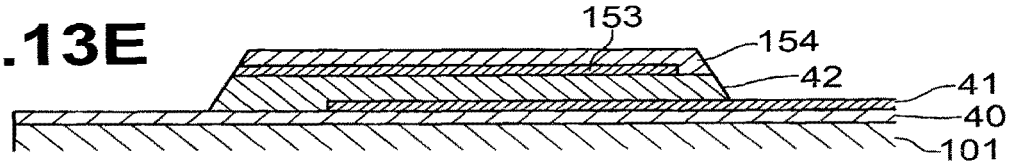
FIG. 13E illustrates a process for forming the first piezoelectric members and the second piezoelectric members using etching, corresponding to a portion of FIG. 10.

As illustrated in FIGS. 12D and 13D, a second layer 103 of a piezoelectric material is formed on an upper surface of the first layer 102 having the middle electrodes 153 thereon using the sol-gel method to cover the first layer 102 and the middle electrodes 153. (This is a second layer forming process.) The second layer 103 is a layer of the piezoelectric material for forming second piezoelectric members 154. The spin coating method is used to apply the piezoelectric material. As illustrated in FIGS. 12E and 13E, first piezoelectric members 42 and second piezoelectric members 154 are formed by etching the first layer 102 and the second layer 103 at one time. (This is an etching process.)

Figure 12F:
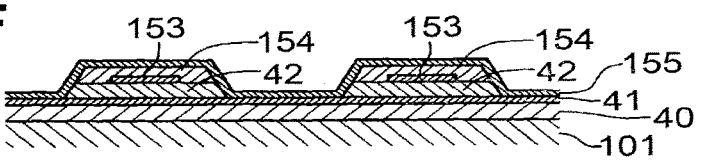
FIG. 12F illustrates a process for forming an upper electrode, corresponding to a portion of FIG. 9.
Figure 12F:
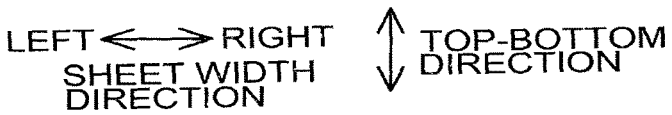
Figure 13F:
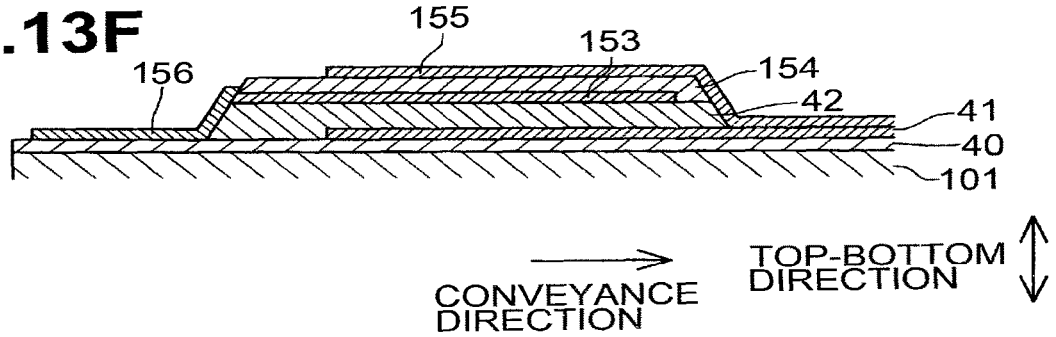
FIG. 13F illustrates a process for forming the upper electrode, corresponding to a portion of FIG. 10.

As illustrated in FIGS. 12F and 13F, an upper electrode 155 is formed covering the lower electrode 41, the first piezoelectric members 42, and the second piezoelectric member 154. (This is a third electrode forming process.) In other words, the upper electrode 155 is formed on the second piezoelectric members 42 covering the middle electrodes 153. Thus, the piezoelectric actuator 150 is completed. Then, a head unit is manufactured in a similar manner as in the first embodiment.

Although not illustrated, the first piezoelectric member 42 and the second piezoelectric member 154 of the second embodiment have films formed using the sol-gel method. The films extend in the sheet width direction and the conveyance direction.

Effects

Even in the second embodiment, the second piezoelectric member 154 has no portions covering the end surfaces 42*a* of the first piezoelectric member 42 in the sheet width direction, thus increasing efficiency to deform the piezoelectric actuator 150. The end surfaces 42*a* of the first piezoelectric member 42 are covered and protected by the upper electrode 155.

In the second embodiment, the first end of the middle electrode 153 in the conveyance direction is exposed to a boundary between the end surface 42*b* of the first piezoelectric member 42 and the end surface 154*b* of the second piezoelectric member 154, and thus the wiring portion 156 can be connected to the exposed end of the middle electrode 153.

In the second embodiment, however, to increase stability of the connection between the middle electrode 153 and the wiring portion 156, the first end of the middle electrode 153 in the conveyance direction is the wide portion 153*a*, which is wider in the sheet width direction than other portions thereof. The wiring portion 156 includes the wide portion 156*a*, which is wider in the sheet width direction than other portions thereof, at the end connected to the middle electrode 153. The middle electrode 153 and the wiring portion 156 have respective connected portions which are wider in the sheet width direction than other portions, thus obtaining stable connection with each other.

In the second embodiment, the end surfaces 42*a* of the first piezoelectric member 42 are contiguous with the end surfaces 154*a* of the second piezoelectric member 154, and the end surfaces 42*b* of the first piezoelectric member 42 are contiguous with the end surfaces 154*b* of the second piezoelectric member 154. Etching the first layer 102 and the second layer 103 at a time forms the first piezoelectric member 42 and the second piezoelectric member 154. This simplifies the manufacture process of the piezoelectric actuator 150.

Alternative Embodiments

The first and second embodiments are merely examples. Various changes, arrangements, and modifications may be applied therein without departing from the spirit and scope of the disclosure.

The first embodiment shows but is not limited to that, the second piezoelectric members 44 each cover the end surfaces 42*b* of a corresponding first piezoelectric member 42 in the conveyance direction. In the first embodiment, a second piezoelectric member 44 may have ends of the lower surface at the same positions as ends of the lower surface of a corresponding first piezoelectric member 42 in the conveyance direction. Alternatively, in the first embodiment, both ends of a second piezoelectric member 44 in the conveyance direction may be located between both ends of a corresponding first piezoelectric member 42.

The second embodiment shows but is not limited to that the first piezoelectric member 42 and the second piezoelectric member 154 are formed by etching the first layer 102 and the second layer 103 at a time. Even in the second embodiment, the first layer 102 may be first etched to form the first piezoelectric member 42, and then the second layer 103 may be formed and etched to form the second piezoelectric member 154, in the same manner as in the first embodiment.

In other words, in the conveyance direction, the second piezoelectric member 154 may have an upstream end located upstream from an upstream end of the first piezoelectric member 42, and may cover the upstream end surface 42*b* of the first piezoelectric member 42. In the conveyance direction, the second piezoelectric member 154 may have a downstream end located downstream from a downstream end of the first piezoelectric member 42, and may cover the downstream end surface 42*b* of the first piezoelectric member 42. Alternatively, in the conveyance direction, both ends of the second piezoelectric member 154 may be located between both ends of a corresponding first piezoelectric member 42.

In the first and second embodiments, the lower electrode 41 continuously extends over the first piezoelectric members 42. In some embodiments, the lower electrode may be broken into multiple parts each disposed between a corresponding one of the first piezoelectric member 42 and the vibration plate 40.

In the first and second embodiments, the first and second piezoelectric members have end surfaces, which are located in the sheet width direction and the conveyance direction, inclined relative to the top-bottom direction. In some embodiments, the end surfaces may extend in the top-bottom direction.

The second embodiment shows but is not limited to that, the first end of the middle electrode 153 in the conveyance direction is the wide portion 153*a*, which is wider in the sheet width direction than other portions thereof. In some embodiments, the middle electrode 153 may have a fixed dimension in the conveyance direction.

In the second embodiment, the middle electrode 153 is exposed to the boundary between the end surface 42*b* of the first piezoelectric member 42 and the end surface 154*b* of the second piezoelectric member 154, and the exposed end of the middle electrode 153 is connected to the wiring portion 156. In some embodiments, the middle electrode 153 may not be exposed to the boundary between the end surface 42*b* of the first piezoelectric member 42 and the end surface 154*b* of the second piezoelectric member 154. In this case, the second piezoelectric member 154 may have a through hole at a position overlapping the middle electrode 153 in the top-bottom direction to connect the middle electrode 153 and the wiring portion via the through hole.

In the first and second embodiments, the second ends of the first piezoelectric members in the conveyance direction are located toward the second side in the conveyance direction further than the second ends of the middle electrodes. In some embodiments, the second ends of the first piezoelectric members in the conveyance direction may be at the same positions as the second ends of the middle electrodes.

In the first and second embodiments, the middle electrode extends opposite to the upper and lower electrodes in the conveyance direction. In some embodiments, the middle electrode and the upper electrode may extend opposite to the lower electrode in the conveyance direction. In this case, the middle electrode, the lower electrode, and the upper electrode may be insulated from one another with, for example, insulating layers, at exposed portions of the middle electrode and the upper electrode in the conveyance direction.

The description has been made on the example in which the disclosure is applied to the piezoelectric actuator to apply pressure to ink in a pressure chamber in the inkjet head for ejecting ink from nozzles. Nevertheless, the disclosure may be applied to a piezoelectric actuator to apply pressure to ink in a pressure chamber in a liquid ejection head for ejecting liquid other than ink. Alternatively, the disclosure may be applied to a piezoelectric actuator constituting a device other than the liquid ejection head.

What is claimed is:

1. A piezoelectric actuator comprising:

a vibration plate;

a first electrode;

a first piezoelectric layer;

a second electrode;

a second piezoelectric layer; and a third electrode, wherein with respect to a top-bottom direction orthogonal to a surface of the vibration plate, the vibration plate, the first electrode, the first piezoelectric layer, the second electrode, the second piezoelectric layer and the third electrode are stacked in this order, the second piezoelectric layer is narrower than the first piezoelectric layer in a first direction parallel to the surface of the vibration plate, and the third electrode extends in the first direction and covers both side surfaces of both of the first piezoelectric layer and the second piezoelectric layer in the first direction.

2. The piezoelectric actuator according to claim 1, wherein both the first piezoelectric layer and the second piezoelectric layer in a second direction, the second direction orthogonal to the top-bottom direction and the second direction orthogonal to the first direction, are each longer than the first piezoelectric layer and the second piezoelectric layer in the first direction, respectively, wherein the second electrode extends a distance in the second direction and contacts the vibration plate, the third electrode extends a distance in the second direction and contacts the first electrode.

3. The piezoelectric actuator according to claim 2, wherein the second direction is bi-directional, and wherein both the first piezoelectric layer and the second piezoelectric layer extend a distance further than the second electrode in a direction of the second direction.

4. The piezoelectric actuator according to claim 1, wherein both the first piezoelectric layer and the second piezoelectric layer in a second direction, the second direction orthogonal to the top-bottom direction and the second direction orthogonal to the first direction, are longer than the first piezoelectric layer and the second piezoelectric layer, in the first direction, wherein the second piezoelectric layer extends further than both side surfaces of the first piezoelectric layer in the second direction.

5. The piezoelectric actuator according to claim 4, wherein the first and second piezoelectric layers are formed by a sol-gel method;

wherein the first piezoelectric layer comprises a plurality of films that extend in the second direction;

wherein the second piezoelectric layer comprises a plurality of films that extend along the first direction.

6. The piezoelectric actuator according to claim 1, wherein the first piezoelectric layer extends beyond both side surfaces of the second piezoelectric layer in the first direction;

wherein the first piezoelectric layer is wider than the second piezoelectric layer in the first direction by at least one of a thickness of the first piezoelectric layer and a thickness of the second piezoelectric layer.

7. The piezoelectric actuator according to claim 1, wherein both sides of the first piezoelectric layer in the first direction are inclined toward a center of the first piezoelectric layer and both sides of the second piezoelectric layer in the first direction are inclined toward a center of a second piezoelectric layer.

8. The piezoelectric actuator according to claim 1, wherein the piezoelectric actuator further comprises another first piezoelectric layer, wherein the first electrode continuously extends across both the first piezoelectric layer and the another first piezoelectric layer.

* * * * *